United States Patent [19]

Bordon

[11] Patent Number: 4,561,356

[45] Date of Patent: Dec. 31, 1985

[54] EXPLOSIVE CHARGE SAFE-ARMING SYSTEM

[75] Inventor: Ernesto E. Bordon, Houston, Tex.

[73] Assignee: Schlumberger Technology Corporation, Houston, Tex.

[21] Appl. No.: 527,062

[22] Filed: Aug. 29, 1983

[51] Int. Cl.[4] ..... F42C 15/00; E21B 43/116

[52] U.S. Cl. ..... 102/202.1; 89/1.15; 102/262; 102/310; 102/318; 166/55.1; 175/4.56; 175/4.6

[58] Field of Search ..... 102/202.1, 254, 258–262, 102/275.4, 275.6, 275.7, 275.11, 275.12, 305, 306, 310, 318, 331; 89/1 C, 1.15; 166/55.1, 297; 175/4.54, 4.55, 4.56, 4.6; 267/164, 165, 158

[56] References Cited

U.S. PATENT DOCUMENTS

| | | | |
|---|---|---|---|
| 399,447 | 3/1889 | Stiles | 267/164 X |
| 3,762,326 | 10/1973 | Edgell et al. | 89/1 C X |
| 3,773,119 | 11/1973 | Shore | 175/4.6 |
| 3,879,025 | 4/1975 | Dillard | 267/165 |
| 4,007,796 | 2/1977 | Boop | 102/306 X |
| 4,011,815 | 3/1977 | Garcia | 166/55.1 X |
| 4,100,978 | 7/1978 | Boop | 102/320 X |
| 4,172,421 | 10/1979 | Regalbuto | 102/331 X |
| 4,292,895 | 10/1981 | Bell et al. | 102/318 X |
| 4,314,614 | 2/1982 | McPhee et al. | 102/320 X |
| 4,319,526 | 3/1982 | Dermott | 102/310 |

*Primary Examiner*—David H. Brown
*Assistant Examiner*—John E. Griffiths

[57] ABSTRACT

A perforating gun having a plurality of shaped charges to be detonated by a primacord positioned adjacent thereto, which primacord is to be actuated by a detonator positioned in detonating proximity to the primacord. The gun of the present invention mounts the primacord and/or detonator within the gun in a manner affording the relative movement therebetween to a position where the primacord and the detonator are non-aligned so as to safe-arm the gun. The relative movement between the primacord and the detonator can be accomplished through the gun carrier so as to simplify the detonation system and minimize any lengthening of the gun required to accomplish the safe-arming.

10 Claims, 4 Drawing Figures

EXPLOSIVE CHARGE SAFE-ARMING SYSTEM

BACKGROUND OF THE INVENTION

The present invention relates to a safety device for an explosive charge and more particularly to a device for safe arming an explosive charge of the type having a detonating cord adjacent thereto which detonating cord can be actuated by a blasting cap positioned adjacent to the detonating cord.

Explosive charges are widely and effectively used within perforating devices for well bore completions of oil wells. Typically these explosive charges are mounted within a suitable strip which is then affixed within a tubular housing or carrier. Collectively these components are referred to as a perforating gun, which gun is then lowered into a borehole on a wireline or other conveyance apparatus. Either a single charge or multiple charges can be mounted within each strip, in a variety of configurations, and with a variety of spacings in between. A detonating cord or primacord for detonating the charges is secured in the vicinity of the rear of each charge and a detonator or blasting cap is secured adjacent one end of the primacord for detonating the primacord. Typically the blasting cap or detonator includes a primary explosive such as lead azide which is ignited when an igniter wire positioned therein is heated by an electrical current. The primary explosive, in turn, sets off a secondary or booster explosive, such as RDX, which develops sufficient energy to detonate the explosive in the primacord, also typically RDX. An electrical current is typically passed from the surface of the ground through the electrical conductors of a cable or the wireline to the igniter wire in the blasting cap. Passage of current through the igniter wire then initiates the aforementioned chain reaction which subsequently detonates the explosive charge.

It will be appreciated that the components of such perforating systems, i.e., the blasting cap, primacord, and explosive charges when interconnected are capable of causing severe damage if accidentally detonated. Accordingly considerable effort has already been expended in developing techniques for "safe-arming" the explosive charges such that the perforating apparatus is able to be safely handled without unplanned detonation.

One type of safe-arming system which has been developed is referred to as a barrier pin safe-arm system. This system positions the primacord and the detonator with a predetermined spacing there between. When the system is safe-armed this space between the primacord and the detonator is occupied by a specialized plug which isolates the primacord from the shock of the detonation of the detonator and thereby imposes a barrier to the detonation of the primacord. Although such a system is generally effective in safe arming the explosive charge, it requires that a specialized adapter be added to the tubular housing of the perforating gun, in order to accurately mount the primacord and detonator. This adapter includes a porthole through its side which is adapted to receive the specialized plug and which affords the extension of the plug through the porthole and into the space between the primacord and the detonator. The adapter must provide an adequate space for the primacord and detonator to be rigidly secured with an adequate separation therebetween to afford the prevention of the transmission of any detonator explosion to the primacord. This distance is large compared to the wall thickness of the standard carrier, and it is therefore very difficult to seal the interface between the porthole and the plug. Since the perforating system must typically operate in a high pressure and fluid environment this interface must however remain water-tight. This need for a water-tight seal is an additional reason for the specialized adaptor which incorporates a substantially thicker housing in order to achieve the seal. Since the plug is providing the barrier for the detonation, the positioning of the primacord and the detonator with respect to the porthole is very critical. This accurate positioning cannot typically be obtained within the standard gun carrier and this provides another reason for the specialized adaptor. The specialized adapter not only introduces additional cost and complexity into the perforating system, it also adds length to the gun which can cause difficulty when inserting the gun into, or when removing the gun from the borehole.

SUMMARY OF THE PRESENT INVENTION

The safe-arm device of the present invention is designed to safely, simply, and inexpensively prevent the unplanned detonation of the explosive charge within a perforating gun in a manner not requiring specialized adaptors or otherwise introducing additional length to the gun. This safe-arming device includes means for causing the detonator and the primacord to become non-aligned in order to prevent any unwanted detonation of the charge. This device is designed to eliminate the need for a specialized adapter within the gun. Rather, the typical carrier can itself be modified to accommodate the present invention and thereby afford a safe-arming of any explosive charge therein.

In one embodiment of the present invention the primacord is moveably mounted within the gun in a manner permitting it to be normally biased out of alignment with a rigidly mounted detonator or blasting cap. An arming screw having sufficient length to contact the primacord, passes through and engages with the carrier of the perforating gun. The proper rotation of this screw advances the screw into the carrier to afford the relative movement of the primacord with respect to the blasting cap. Thus the rotation of this screw can be used to bring the primacord into alignment with the blasting cap. In another embodiment the primacord is mounted in a manner permitting it to be biased into alignment with the blasting cap and the safe-arm screw is utilized to cause the non-alignment between the blasting cap and the primacord.

Since the safe-arming is provided through lateral displacement between the primacord and the blasting cap, the resulting porthole and arming screw therein need not have a diameter sufficient to prevent the transmission of the blasting cap's explosion. Thus the sealing difficulties extant with the previously described safe-arming apparatus are minimized.

DESCRIPTION OF THE ACCOMPANYING DRAWING

The present invention will be further described hereinafter with reference to the accompanying drawing wherein:

FIG. 1 illustrates a typical perforating apparatus employing the principles of the present invention; and FIGS. 2 through 4 illustrate enlarged, partial, schematic depictions of a safe-arm device according to the present invention.

DETAILED DESCRIPTION

Figure 1:
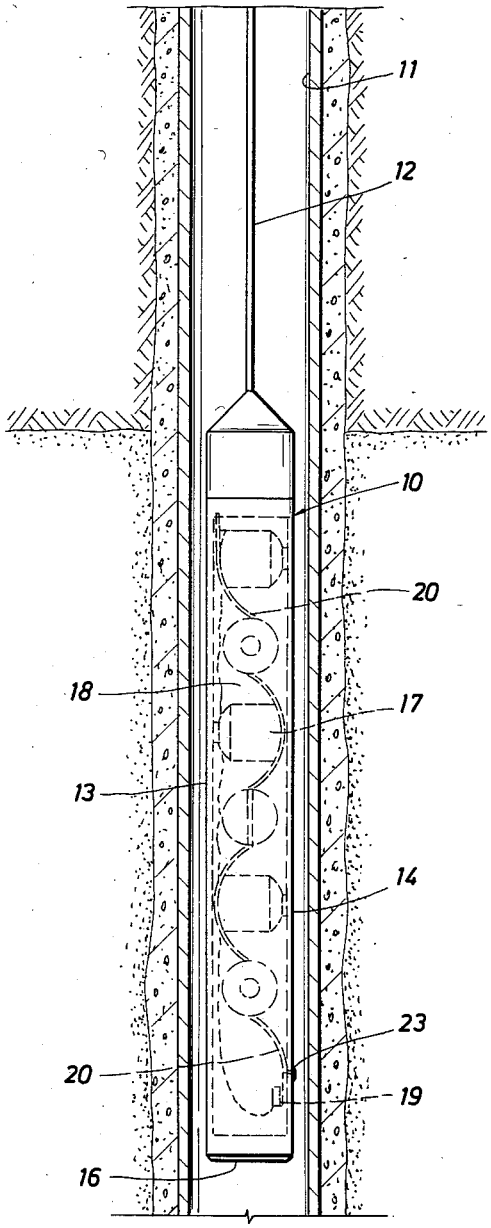

A perforating apparatus 10 incorporating the principles of the present invention is illustrated in FIG. 1 as it would appear suspended in a wellbore 11 by a wireline 12. The perforating gun 10 includes a thick walled tubular housing or carrier 13 formed from steel or the like having a plurality of longitudinally spaced lateral domes 14 in which the housing 13 has been adapted to facilitate the firing of explosive charges therethrough. To provide access to the interior of the carrier 13, its lower end is closed by a removable end closure 16.

The perforating apparatus 10 further includes perforating means comprised of a plurality of laterally oriented shaped explosive charges 17 which are disposed at longitudinally-spaced intervals within a corresponding charge strip 18. The strip 18 and the charges 17 secured therein are positioned within the carrier 13 such that each of the charges 17 faces a lateral dome 14. Depending upon the desired pattern for the perforation, the shaped charges 17 can be oriented to face in the same lateral direction or to face in alternately diametrically opposed directions. Understandably the domes 14 are also oriented in the same pattern as the shaped charges 17. The perforating means further includes selectively operable detonating means such as an electrically responsive blasting cap 19 which is operatively positioned in the vicinity of a length of detonating cord or primacord 20 that is also affixed to the strip 18 in detonating proximity of each of the shaped charges 17. The structure of the individual shaped charges such as utilized by the present invention is discussed in U.S. Pat. No. 3,773,119, the content of which is incorporated herein by reference. This explanation will not be repeated for the sake of simplicity.

Figure 2:
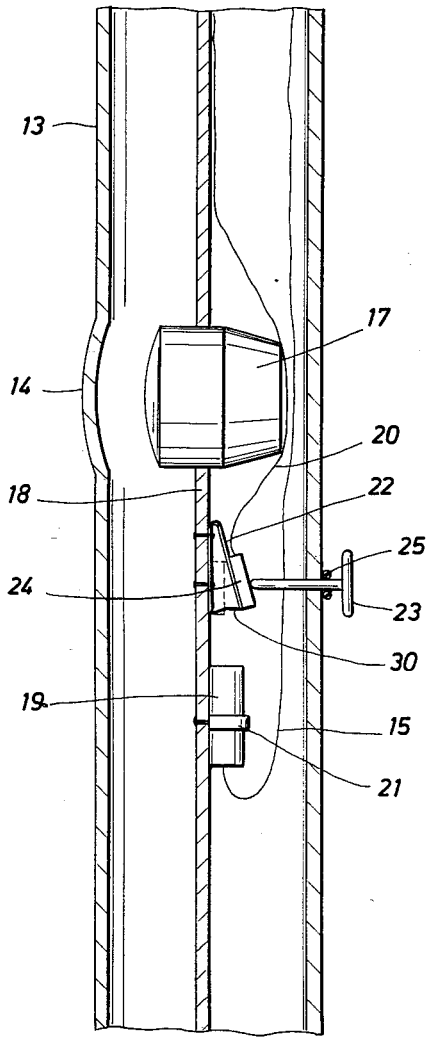

The actual construction of the safe arm device according to the present invention is best illustrated in FIG. 2. As can be seen, the blasting cap 19 is rigidly positioned with respect to the strip 18. For example, bracket means 21 mounts the blasting cap 19 on the strip 18. The blasting cap 19 is electrically connected to the wireline 12 by a connecting wire 15 which provides the current to the igniter wire of the blasting cap 19 upon an appropriate command from the surface. The type of blasting cap 19 which is utilized is designed such that the explosive force which is generated is directional. Hence the explosive force which is generated can be directed toward the primacord 20 positioned adjacent thereto. The primacord 20 is also affixed to the strip 18. This is done however in a manner permitting the movement of the primacord 20 with respect to the strip 18 from a first position wherein the primacord 20 is aligned with the blasting cap 19 such that the explosive force generated by the blasting cap 19 is directed toward the primacord 20 so as to initiate an explosive reaction within the primacord 20, to a second position where the primacord is moved out of alignment with respect to the blasting cap 19 such that any explosive force generated by the blasting cap 19 will not initiate an explosive reaction within the primacord 20. In the embodiment illustrated the primacord 20 is normally biased to this second position. This can be accomplished with a conventional leaf spring 22 or other biasing means, one end of which is affixed to the strip 18 and the other end affixed to the primacord 20. The biasing means 22 therefore positions the primacord 20 such that it is normally non-aligned with the blasting cap 19. This non-alignment is of a sufficient lateral displacement to safe-arm the explosive charge. The movement of the primacord 20 with respect to the blasting cap 19 is accomplished by the rotation of a threaded screw 23 which engages corresponding threads within the carrier 13. This screw 23 has an adequate length to contact the primacord 20 and to move the primacord 20 with respect to the blasting cap 19 as the screw 23 is rotated. Hence the screw 23 will move the primacord 20 into alignment with the blasting cap 19 and thereby permit the detonation of the explosive charge 17. It should be noted that the present invention also contemplates the replacement of screw 23 with a shorter screw (not shown) while the gun is in its safe-armed position. This shorter screw does not have sufficient length to contact the primacord 20 even when it is fully engaged. The use of a specially designated shorter safe-arm screw permits the safe shipping of the tool without having the head end of the screw extending from the gun housing, or without leaving an open hole in the gun housing.

In order to facilitate the movement of the primacord 20 by the screw 23 as well as to prevent any spillage of explosive within the primacord 20, the end of the primacord 20 is typically terminated with an outer protective shell 24 that is crimped onto the end of the primacord 20 prior to the installation of the primacord 20 within the perforating gun 10. This embodiment also illustrates the use of a deformable stop mechanism 30 which can be positioned between the biasing means 22 and the strip 18. This stop mechanism 30 adds additional protection against the unplanned detonation of the primacord 20 since the material 30 must be broken or otherwise deformed in order to bring the primacord 20 into alignment with the blasting cap 19. Since the explosive materials utilized by the present invention are sensitive to moisture, suitable sealing means such as the gasket 25 further ensure the seal within the interface between the screw 23 and the housing 13 to prevent the entrance of moisture within the apparatus 10. The smaller porthole required for the present invention is substantially easier to seal than the porthole within the barrier-pin safe-arming system, and the positioning of the porthole, blasting cap 19 and primacord 20 need not be as accurate. Thus a standard gun carrier can be modified to incorporate the present invention and a specialized adaptor is not required.

Figure 3:
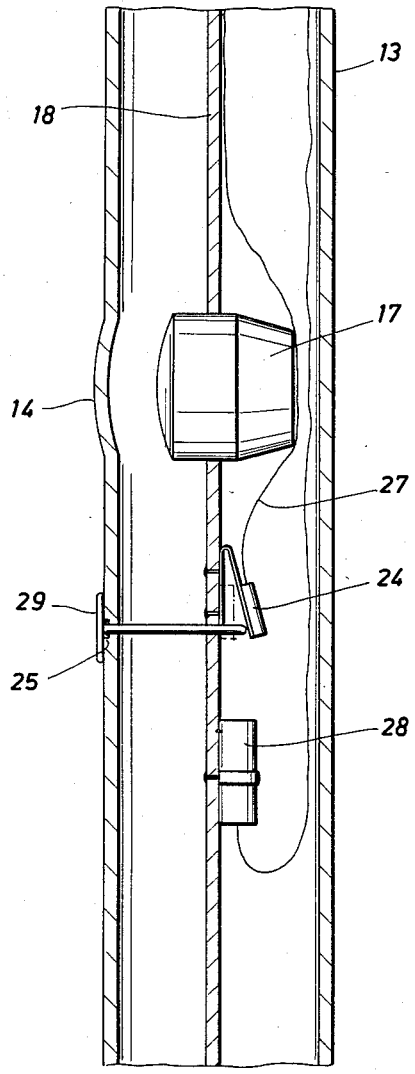

A second embodiment of the present invention is illustrated in FIG. 3. In this embodiment the primacord 27 is normally biased into alignment with the blasting cap 28, and the screw 29 is used to move the primacord 27 out of alignment with the blasting cap 28.

Figure 4:
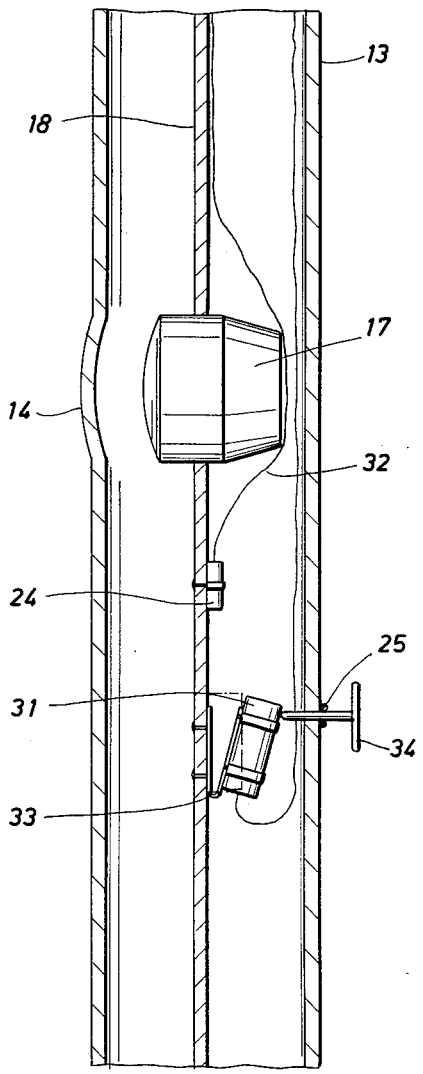

A third embodiment is illustrated in FIG. 4. In this embodiment the primacord 32 is rigidly positioned and the blasting cap 31 normally biased out of alignment with the primacord 32. With this embodiment the screw 34 is used to move the blasting cap 31 into alignment with the primacord 32.

Having thus described several embodiments of the present invention it will be understood that changes may be made in the size, shape or configuration of some of the parts without departing when the present invention is described in the appended claims.

I claim:

1. An explosive charge safe-arming system for a perforating gun comprising a shaped charge carrier, a support within said carrier, a detonating cord having a force receiving end and at least one shaped charge attached to said detonating cord and activated thereby, said safe-arming system comprising:

a blasting cap having a force transmitting end and configured to generate a directional explosive force capable of actuating said detonating cord, said blasting cap for rigidly mounting within said perforating gun to said support for said at least one shaped charge such that the direction of said explosive force is fixed in relation to said support;

a leaf spring biasing means for movably mounting the force receiving end of said detonating cord adjacent to the force transmitting end of said blasting cap and movable by lateral displacement into and out of alignment with the direction of travel of said explosive force; and, arming means for penetrating said shaped charge carrier and contacting said leaf spring biasing means, said arming means being movable to alter the alignment of the force receiving end of the detonating cord with the direction of travel of said explosive force, whereby actuation of said detonating cord by said blasting cap can be prevented in a non-aligned position and permitted in an aligned position.

2. The explosive charge safe-arming system of claim 1 wherein said leaf spring biasing means normally biases said force receiving end of said detonating cord into alignment with the direction of travel of the explosive force and said arming means is movable to bring the force receiving end of said detonating cord out of alignment with said direction of travel.

3. The explosive charge safe-arming system of claim 2 wherein said arming means comprises an arming screw with an end abutting said leaf spring biasing means, said arming screw being rotatable to retract said screw out of said shaped charge carrier and thereby cooperate with the normal bias of the leaf spring biasing means to bring the force receiving end of said detonating cord into alignment with said direction of travel.

4. The explosive charge safe-arming system of claim 2 further comprising sealing means between said arming means and said shaped charge carrier, said sealing means substantially preventing the entrance of moisture into said shaped charge carrier.

5. The explosive charge safe-arming system of claim 1 wherein said leaf spring biasing means normally biases said force receiving end of said detonating cord out of alignment with the direction of travel of the explosive force and said arming means is movable to bring the force receiving end of said detonating cord into alignment with said direction of travel.

6. The explosive charge safe-arming system of claim 5 wherein said arming means comprises an arming screw with an end abutting said leaf spring biasing means, said arming screw being rotatable to advance said screw into said shaped charge carrier and thereby bring the force receiving end of said detonating cord into alignment with said direction of travel.

7. The explosive charge safe-arming system of claim 5 further comprising a deformable stop means mounted between said support and said leaf spring biasing means, said stop means bracing said leaf spring biasing means out of alignment with the direction of travel of said explosive force, said stop means deformable by the operation of the movable arming means to eliminate said bracing.

8. The explosive charge safe-arming system of claim 5 further comprising sealing means between said arming means and said shaped charge carrier, said sealing means substantially preventing the entrance of moisture into said shaped charge carrier.

9. An explosive charge safe-arming system for a perforating gun comprising a shaped charge carrier, a support within said carrier, a detonating cord and at least one shaped charge attached to said detonating cord and activated thereby, said safe-arming system comprising:

a detonating cord with an end configured to receive an actuating directional explosive force, said detonating cord for rigidly mounting within said perforating gun to said support for said at least one shaped charge such that the direction in which said directional explosive force is received by said detonating cord is fixed in relation to said support;

a blasting cap having a force transmitting end and configured to generate and transmit said directional explosive force;

a leaf spring biasing means for movably mounting the force transmitting end of said blasting cap adjacent to the force receiving end of said detonating cord and movable by lateral displacement into and out of alignment with the direction in which said directional explosive force is received by said detonating cord; and, arming means for penetrating said shaped charge carrier and contacting said leaf spring biasing means, said arming means being movable to alter the alignment of the force transmitting end of the blasting cap with the direction in which said directional explosive force is received by said detonating cord, whereby actuation of said detonating cord by said blasting cap can be prevented in a non-aligned position and permitted in an aligned position.

10. The explosive charge safe-arming system of claim 9 wherein said leaf spring biasing means normally biases said force transmitting end of said blasting cap out of alignment with the direction in which said directional explosive force is received by said detonating cord and said arming means is movable to bring the force transmitting end of said blasting cap into alignment with said direction of travel.

* * * * *